US008899007B2

(12) United States Patent
Cheng et al.

(10) Patent No.: US 8,899,007 B2
(45) Date of Patent: Dec. 2, 2014

(54) OPEN MULTI-STRAND CORD

(75) Inventors: Zhichao Cheng, Jiangyin (CN); Pengfei Wang, Jiangyin (CN); Huanjiong Pang, Jiangyin (CN)

(73) Assignee: NV Bekaert SA, Zwevegem (BE)

( * ) Notice: Subject to any disclaimer, the term of this patent is extended or adjusted under 35 U.S.C. 154(b) by 271 days.

(21) Appl. No.: 13/510,465

(22) PCT Filed: Oct. 28, 2010

(86) PCT No.: PCT/EP2010/066356

§ 371 (c)(1),
(2), (4) Date: May 17, 2012

(87) PCT Pub. No.: WO2011/064065

PCT Pub. Date: Jun. 3, 2011

(65) Prior Publication Data

US 2012/0227885 A1 Sep. 13, 2012

(30) Foreign Application Priority Data

Nov. 27, 2009 (WO) ..... PCT/CN2009/001338

(51) Int. Cl.
*D07B 1/06* (2006.01)

(52) U.S. Cl.
CPC ..... *D07B 1/0613* (2013.01); *D07B 2201/204* (2013.01); *D07B 1/0626* (2013.01); *D07B 2401/208* (2013.01); *D07B 2201/102* (2013.01); *D07B 2201/2031* (2013.01); *D07B 2501/2046* (2013.01); *D07B 2201/2023* (2013.01); *D07B 2201/2051* (2013.01); *D07B 1/0633* (2013.01); *D07B 2201/1064* (2013.01)
USPC ..... 57/237

(58) Field of Classification Search
CPC ..... D02G 3/48; D07B 1/0606; D07B 1/0613; D07B 1/062; D07B 1/0626; D07B 1/0633
USPC ..... 57/213, 214, 218, 230, 231, 237
See application file for complete search history.

(56) References Cited

U.S. PATENT DOCUMENTS

| | | | | | |
|---|---|---|---|---|---|
| 3,555,789 | A * | 1/1971 | Terragna | ..... | 57/218 |
| 4,365,467 | A * | 12/1982 | Pellow | ..... | 57/214 |
| 4,947,636 | A * | 8/1990 | Sinopoli | ..... | 57/218 |
| 5,351,470 | A * | 10/1994 | Shinmura | ..... | 57/213 |
| 5,461,850 | A * | 10/1995 | Bruyneel et al. | ..... | 57/212 |
| 6,272,830 | B1 * | 8/2001 | Morgan et al. | ..... | 57/213 |

(Continued)

FOREIGN PATENT DOCUMENTS

| | | |
|---|---|---|
| EP | 0 602 733 B1 | 11/1997 |
| JP | 8-81889 A | 3/1996 |

(Continued)

*Primary Examiner* — Shuan R Hurley
(74) *Attorney, Agent, or Firm* — Foley & Lardner LLP

(57) ABSTRACT

A steel cord (10) adapted for the reinforcement of rubber products, comprises a core strand (12) and six peripheral strands (14) concentrically surrounding the core strand (12). Each of the core and peripheral strands (12, 14) comprises a center of two or more center filaments (16) and two layers of filaments surrounding the center. The core strand (12) has a diameter D1 which is greater than the diameter D2 of the peripheral strands (14). All the filaments (18, 20) of each layer have substantially the same diameter and a radially outer layer has a twist angle which is greater than a twist angle of a radially inner layer of the same strand. Each of the strands (12, 14) in the cord is composed of no more than twenty-six filaments (16, 18, 20) being twisted together.

14 Claims, 2 Drawing Sheets

(56) References Cited

U.S. PATENT DOCUMENTS

| | | | | |
|---|---|---|---|---|
| 7,093,634 | B2 * | 8/2006 | Rayman et al. | 152/526 |
| 7,104,299 | B2 * | 9/2006 | Rayman et al. | 152/170 |
| 7,458,200 | B2 * | 12/2008 | Kish | 57/237 |
| 2005/0178103 | A1 * | 8/2005 | Black | 57/213 |
| 2007/0130905 | A1 * | 6/2007 | Kish | 57/237 |
| 2007/0131331 | A1 * | 6/2007 | Neubauer et al. | 152/527 |
| 2008/0028740 | A1 * | 2/2008 | Ushijima | 57/204 |
| 2010/0170215 | A1 * | 7/2010 | Nishimura | 57/258 |

FOREIGN PATENT DOCUMENTS

| | | | |
|---|---|---|---|
| JP | 2005-314833 | A | 11/2005 |
| JP | 2006-104636 | A | 4/2006 |
| JP | 2008-260409 | A | 10/2008 |
| WO | WO 2009/048054 | A | 4/2009 |
| ZA | 200 403 922 | A | 5/2005 |

* cited by examiner

OPEN MULTI-STRAND CORD

TECHNICAL FIELD

The invention relates to a multi-strand steel cord adapted to reinforce rubber products, such as rubber track and heavy duty tires for off-the-road and earthmover applications.

BACKGROUND ART

The large off-the-road pneumatic tires used in heavy construction and earthmoving operations have operating loads and inflation pressures much higher than conventional trucks and lightweight vehicles. Therefore, the radial plies earthmover tires need particular reinforcing cords.

Since the steel cord for reinforcing the tire is required to have high breaking load and high fatigue resistance, conventionally a steel cord having a multi-strand structure is widely used. A multi-strand structure has multiple strands each composed of a plurality of steel filaments that are twisted together. The strands are twisted together to form the cord. For example, a steel cord having a 7×(3+9+15)+1 structure, as shown in FIG. 1 is known. However, the structure 7×(3+9+15)+1 has a relatively low fatigue resistance.

Besides, the other concern for the performance of the off-the-road tire is insuring adequate rubber penetration into the cords. During the manufacture of the belt layers and in the subsequent tire vulcanization rubber is expected to penetrate into all voids between the filaments so as to assure an adequate corrosion protection. Unfortunately, the conventional structure 7×(3+9+15)+1 shows in general insufficient rubber penetration.

EP 0 602 733 B1 discloses a multi-strand steel cord comprising a core strand and up to nine peripheral strands surrounding the core, each strand having a centre of one or more centre filaments and two or more layers of filaments surrounding the centre. The steel cord of this patent has an adequate rubber penetration which is obtained by providing free spaces between the individual filaments after careful choice of the twisting angles.

The twist angle of a layer is within the context of EP 0 602 733 B1 defined as follows. Suppose that $d_1$ is the (total) diameter of the center, that $d_2$ is the diameter of the filaments of the radially inner layer which immediately surrounds the center and that $d_3$ is the diameter of the filaments of a second layer surrounding the radially inner layer (=radially outer layer).

$LL_2$ is the lay length of the radially inner layer and $LL_3$ is the lay length of the radially outer layer.

The twist angle of the radially inner layer is defined as:

$$\alpha_2=\text{arctg}\ [(d_1+d_2)\times\pi/LL_2]\times 180/\pi$$

The twist angle of the second layer is defined as:

$$\alpha_3=\text{arctg}\ [(d_1+2\times d_2+d_3)\times\pi/LL_3]\times 180/\pi$$

JP2006-104636A discloses a steel cord reinforcing rubber products, which comprises one core strand of layer twisting structure of two or three layers and six sheath strands of layer twisting structure of two or three layers surrounding this core strand. All the layer twist directions in core strand and the twist direction of sheath strands are the same, but the layer twist direction in sheath strand consisting of combination of different directions, which results in large loss of tensile strength and large loss of breaking load.

DISCLOSURE OF INVENTION

It is an object of the invention to provide a multistrand steel cord with an adequate rubber penetration coupled with a maximum reinforcement degree and maximum resistance against fatigue.

A steel cord adapted for the reinforcement of rubber products, comprises a multi-strand structure that includes a core strand and six peripheral strands concentrically surrounding the core strand; each of the core and peripheral strands comprising a centre of two or more centre filaments and two layers of filaments surrounding the centre; the core strand having a diameter D1 which is greater than the diameter D2 of the peripheral strands; all the filaments of each layer having substantially the same diameter and the twist angle of a radially outer layer greater than the twist angle of a radially inner layer of the same strand; each of the strands in the cord is composed of no more than twenty-six filaments being twisted together.

The maximum number of filaments in each strand is twenty-six, as there are two or more centre filaments and two layers of filaments surrounding the centre, if the number is more than twenty-six, the chance for a saturated layer is great, which will result in insufficient rubber penetration.

Preferably, in each strand, the diameter of the filaments in the centre are greater than or equal to the diameter of the first surrounding layer. Also preferably, the diameter of the filaments of the first surrounding layer are greater than or equal to the diameter of the filaments of the second surrounding layer.

A steel cord according to a first embodiment of the present invention has a number of centre filaments of each of the core and peripheral strands equal to two. If the number of centre filaments of each of the core and peripheral strands is only one and the total number of filaments in each strand is no more than twenty-six, on one hand, the chance for a saturated layer, not only the inner layer but also the outer layer, is great, which will result in insufficient rubber penetration; on the other hand, if each strand has unsaturated layer(s) for good rubber penetration, the total number of the filaments of each strand would reduce, which will result in less reinforcement degree.

Preferably, each of the core and peripheral strands further has a radially inner layer of eight filaments and a radially outer layer of fourteen filaments being twisted with the centre filaments. Each of the strands in the cord is composed of twenty-four filaments being twisted together, having a 2+8+14 structure. So the total cord has as formula: 7×(2+8+14).

Preferably, each of the core and peripheral strands further has a radially inner layer of seven filaments and a radially outer layer of thirteen filaments being twisted with the center filaments. Each of the strands in the cord is composed of twenty-two filaments being twisted together, having a 2+7+13 structure. So the total cord has as formula: 7×(2+7+13).

A second embodiment of the steel cord according to the present invention has as number of centre filaments of each of the core and peripheral strands equal to three.

Preferably, each of the core and peripheral strands further has a radially inner layer of eight filaments and a radially outer layer of fourteen filaments being twisted with the centre filaments. Each of the strands in the cord is composed of twenty-five filaments being twisted together, having a 3+8+14 structure. So the formula of the total cord is 7×(3+8+14).

Preferably, each of the core and peripheral strands further has a radially inner layer of seven filaments and a radially outer layer of thirteen filaments being twisted with the centre filaments. Each of the strands in the cord is composed of twenty-three filaments being twisted together, having a 3+7+13 structure. So the formula of the total cord is 7×(3+7+13).

If the number of centre filaments of each of the core and peripheral strands is more than three, for example, four centre filaments, as the total number of filaments in each strand is no more than twenty-six, the chance for a less uniform cross-section obtained along the cord length has increased.

All the layers of the core strand are preferably twisted in a first direction. The layers of peripheral strands are preferably twisted in this first direction, while peripheral strands are twisted around the core strand in a direction opposite to this first direction. This is done in order to reduce the loss of tensile strength.

The ratio core strand diameter to peripheral strand diameter D1/D2 is preferably greater than 1.06 and smaller than 1.20. If D1/D2 is smaller than 1.06, the chance for insufficient rubber penetration is great. If D1/D2 is greater than 1.20, a less uniform cross-section is obtained along the cord length.

The diameter of the steel filaments of each of the core and peripheral strands ranges from 0.15 mm to 0.38 mm, e.g. from 0.24 mm to 0.28 mm.

The steel filaments may be provided with a copper alloy coating such as brass if adhesion to the rubber is a dominant factor, or with zinc or a zinc alloy coating if resistance to corrosion is a dominant factor.

A steel cord according to the invention may be used as a reinforcement for an off-the-road tire, e.g. in one of the outermost belt layers of the off-the-road tire.

A steel cord according to the invention may be used as a reinforcement for rubber track.

BRIEF DESCRIPTION OF FIGURES IN THE DRAWINGS

The invention will now be explained in more detail with reference to the accompanying figures.

MODE(S) FOR CARRYING OUT THE INVENTION

Figure 1:
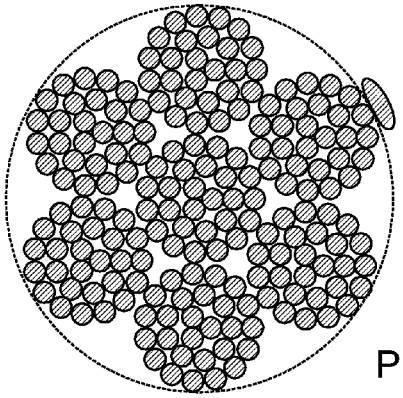
PRIOR ART Fig. 1
FIG. 1 shows schematically a cross-section of a multi-strand steel cord according to the comparative prior art example.
Figure 2:
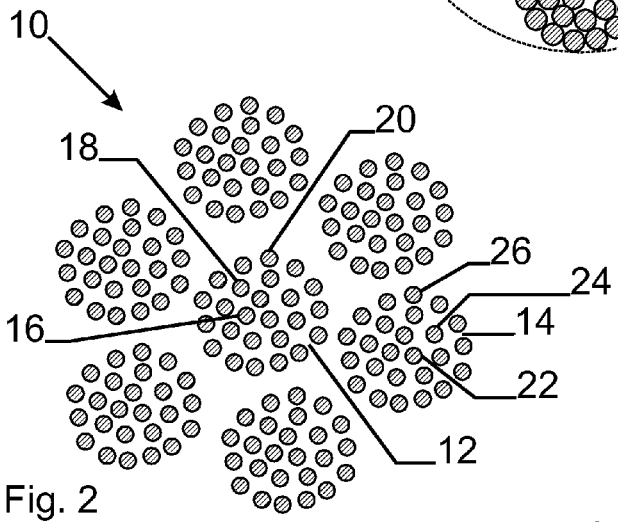
FIG. 2 shows schematically a cross-section of a multi-strand steel cord according to the present invention.

Referring to FIG. 2, a multi-strand steel cord 10 according to the invention comprises a core strand 12 and six peripheral strands 14 which surround the core strand 12.

The core strand 12 comprises three centre filaments 16 surrounded by a radially inner layer of eight steel filaments 18 and by a radially outer layer of fourteen steel filaments 20. The diameter of centre filaments 16 is greater than or equal to the diameter of filament 18 and the diameter of filament 18 is the same as the diameter of filament 20.

Each peripheral strand 14 comprises three centre filaments 22 surrounded by a radially inner layer of eight steel filaments 24 and by a radially outer layer of fourteen steel filaments 26. The diameter of centre filaments 22 is greater than or equal to the diameter of steel filaments 24 and the diameter of steel filaments 24 is the same as the diameter of steel filaments 26.

Multi-strand steel cord 10 can be manufactured according to following well known process steps:

- a conventional drawing process, if necessary combined with the proper number of intermediate patenting steps;
- a conventional galvanising process or other coating process such as brass coating, etc.
- a conventional twisting process, e.g. by twisting first the individual strands followed by twisting the strands into the cord, this twisting can be done by means of a conventional tubular twisting machine or by means of a well-known double-twisting machine.

Depending upon the choice of the wire rod and of the applied thermo-mechanical treatments, different levels of tensile strengths can be obtained for the different steel filaments of the steel cord. As a general rule, however, it can be stated that all filaments with the same diameter and which occupy a similar place in the cord, have about the same tensile strength. Conventionally, the wire rod has following steel composition: A minimum carbon content of 0.65%, a manganese content ranging from 0.40% to 0.70%, a silicon content ranging from 0.15% to 0.30%, a maximum sulphur content of 0.03%, a maximum phosphorus content of 0.30%, all percentages being percentages by weight. A typical steel tire cord composition for high-tensile steel cord has a minimum carbon content of around 0.80 weight %, e.g. 0.78-0.82 weight %.

The present invention will be described in detail with reference to examples below.

Example 1

An example according to the present invention (Example 1) is as follows:

cord diameter D is 4.50 mm core strand 12 diameter D1 is 1.615 mm (Z-lay) 3×0.265 mm (centre filaments 16), lay length 6.3 mm (Z-lay)+8×0.265 mm (filaments 18), lay length 12.5 mm (Z-lay)+14×0.265 mm (filaments 20), lay length 18 mm $\alpha_2$=11.87°; $\alpha_3$=13.41° six peripheral strands 14 diameter D2 is 1.493 mm (Z-lay) 3×0.245 mm (centre filaments 22), lay length 6.3 mm (Z-lay)+8×0.245 mm (filaments 24), lay length 12.5 mm (Z-lay)+14×0.245 mm (filaments 26), lay length 18 mm $\alpha_2$=10.99°; $\alpha_3$=12.43° cord: lay length of 50 mm, S-lay

The ratio D1/D2 is 1.082. The weight of the cord per m is 68.3 g and the breaking load is 21000 N.

All the filaments of each layer have substantially the same diameter and a radially outer layer has a twist angle $\alpha_3$ which is greater than a twist angle $\alpha_2$ of a radially inner layer of the same strand.

This steel cord according to the invention has been compared with a reference cord which does not have all features of claim 1. The characteristics of the prior art reference cord are as follows:

cord construction 7×(3+9+15×0.245 mm)+0.245 mm lay length 6.3/12.5/18/55/5 lay direction ZZZSZ cord diameter 4.84 mm

The ratio D1/D2 is 1.204, the weight of the cord per m is 345.2 g and the breaking load is 22385 N.

Figure 3:
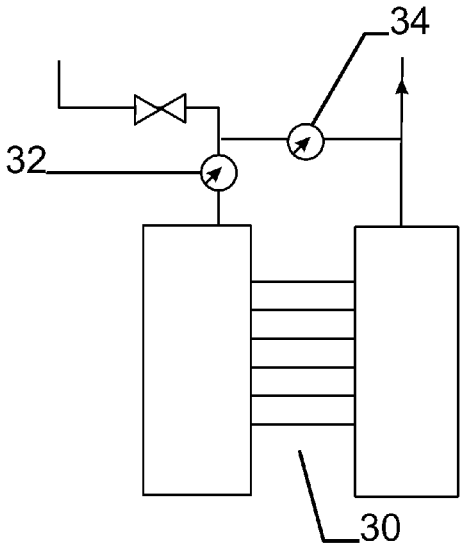
FIG. 3 illustrates the air drop test.
Figure 4:
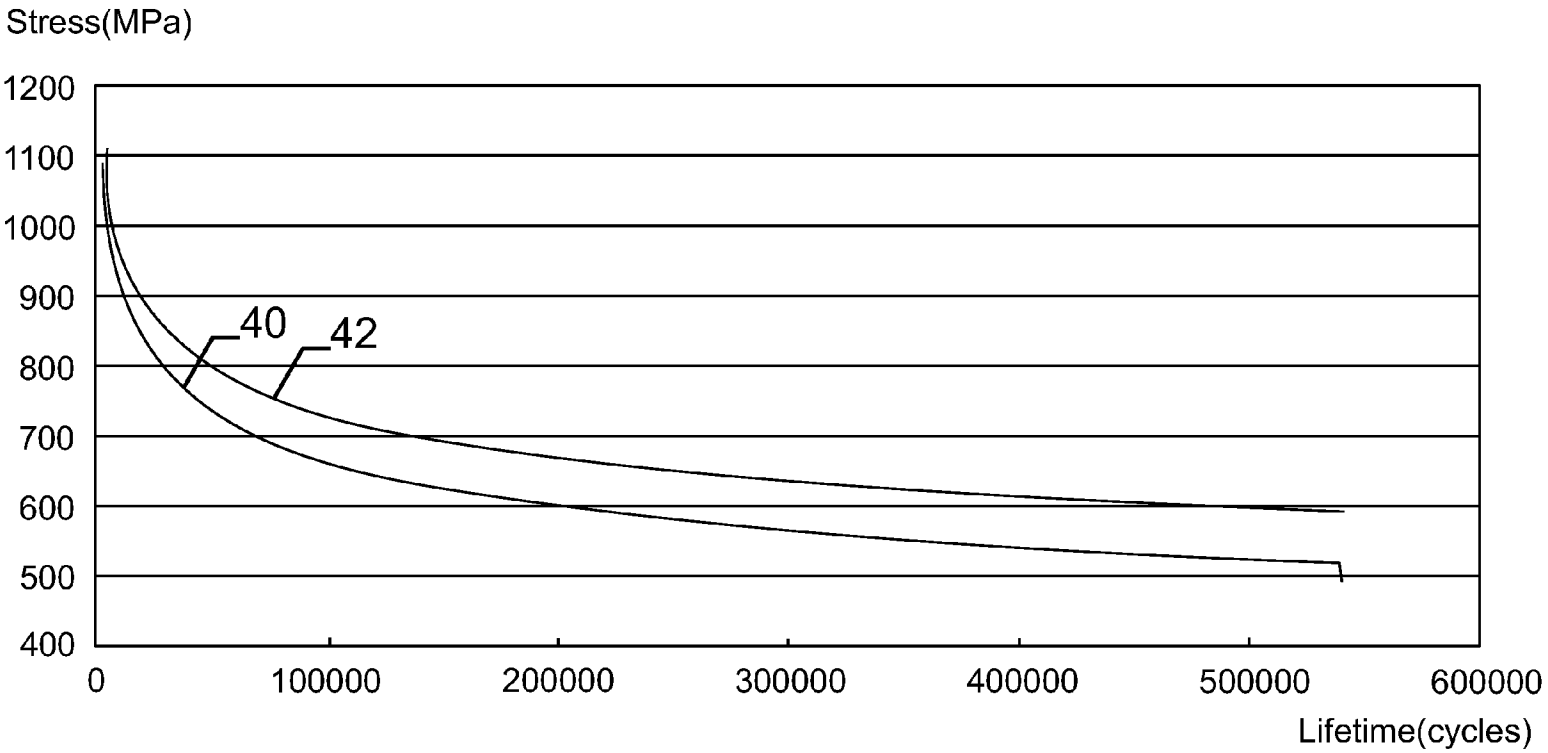
FIG. 4 illustrates the improvements of fatigue resistance of steel cord according to the present invention.

A method and an instrument for measuring rubber penetration have been illustrated in FIG. 3 (Air permeability method). Air under known pressure (32, 1 Bar) is supplied on one side of the tire cord specimen (30) that has been cured in rubber and is caught at the other side. The pressure drop after a certain period (several seconds) is a measurement for air permeability. Read the Δp (34, differential pressure) from the display up to 0.01 bar. Complete (100%) rubber penetration when indicated value (ΔP) is equal to 1000 mbar. No (0%) rubber penetration when indicated value (ΔP) is equal to 0 mbar. Measuring results obtained with this method are shown in Table 1 and Table 2.

TABLE 1

| Example 1 Invention Steel Cord | | | |
|---|---|---|---|
| | Time(sec.) | Air drop (%) | other |
| No. 1 | 2 | 0 | 350 mm |
| No. 2 | 3 | 0 | 350 mm |
| No. 3 | 7 | 0 | 350 mm |
| No. 4 | 8 | 0 | 350 mm |
| No. 1 | 2 | 0 | 198 mm |
| No. 2 | 3 | 0 | 198 mm |
| No. 3 | 7 | 0 | 198 mm |
| No. 4 | 8 | 0 | 198 mm |
| No. 1 | 2 | 0 | 49.5 mm |
| No. 2 | 3 | 0 | 49.5 mm |
| No. 3 | 7 | 0 | 49.5 mm |
| No. 4 | 8 | 0 | 49.5 mm |

TABLE 2

| Reference prior art cord | | | |
|---|---|---|---|
| | Time(sec.) | Air drop (%) | other |
| No. 1 | 2 | 100 | 350 mm |
| No. 2 | 3 | 100 | 350 mm |
| No. 3 | 7 | 100 | 350 mm |
| No. 4 | 8 | 100 | 350 mm |
| No. 1 | 2 | 100 | 198 mm |
| No. 2 | 3 | 100 | 198 mm |
| No. 3 | 7 | 100 | 198 mm |
| No. 4 | 8 | 100 | 198 mm |
| No. 1 | 2 | 100 | 64 mm |
| No. 2 | 3 | 25 | 64 mm |
| No. 3 | 7 | 100 | 64 mm |
| No. 4 | 8 | 100 | 64 mm |

As shown in Table 1 and Table 2, the invention cord offers a much better rubber penetration than the reference cord.

This means that the spaces between the invention cord filaments are filled up completely. In contradistinction herewith, the pressure drop is considerable for the reference cord, as is shown by Table 2. This indicates the presence of cavities running along the interstices between the filaments through which the air can pass thereby causing a substantial pressure drop. The above results are confirmed when examining the rubber penetration visually after cutting the cords out of the belt section. The different strands are untwisted from both the invention cord and the reference cord, and the filaments of each strands are also untwisted subsequently.

The results of a fatigue test are illustrated by an S-N curve, also known as a Wöhler curve. This is a graph of the magnitude of a cyclical stress (S) against the logarithmic scale of cycles to failure (N).

Curve 42 is the S-N curve for the Example 1 steel cord according to the invention, while curve 40 is the S-N curve for the reference steel cord.

At a certain stress, for example, 700 MPa, the number of cycles of the example invention cord is much greater than the number of cycles of the reference prior art cord. It means that the life time of the reference cord is less than the example cord's at a certain stress.

At a certain cycles, for example, 100000 cycles, the example cord could survive at a much higher stress. It means the reference cord would capture a greater probability of failure at a given number of cycles as the stress increases.

From above comparison test, the example steel cord according to present invention improves the fatigue resistance significantly compared with the reference cord at the same level of breaking load.

Other examples according to the present invention are as follows.

Example 2 cord diameter D is 4.50 mm
core strand diameter D1 is 1.574 mm
(Z-lay) 2×0.285 mm (centre filaments), lay length 6.3 mm
(Z-lay)+8×0.265 mm (filaments), lay length 12.5 mm
(Z-lay)+14×0.265 mm (filaments), lay length 18 mm
$\alpha_2$=11.85°; $\alpha_3$=13.40°
six peripheral strands diameter D2 is 1.455 mm
(Z-lay) 2×0.265 mm (centre filaments), lay length 6.3 mm
(Z-lay)+8×0.245 mm (filaments), lay length 12.5 mm
(Z-lay)+14×0.245 mm (filaments), lay length 18 mm
$\alpha_2$=11.02°; $\alpha_3$=12.45°
cord: lay length of 50 mm, S-lay Example 3 cord diameter D is 4.50 mm
core strand diameter D1 is 1.615 mm
(Z-lay) 3×0.265 mm (centre filaments), lay length 6.3 mm
(Z-lay)+8×0.265 mm (filaments), lay length 12.5 mm
(Z-lay)+14×0.265 mm (filaments), lay length 18 mm
$\alpha_2$=11.87°; $\alpha_3$=13.41°
six peripheral strands diameter D2 is 1.455 mm
(Z-lay) 2×0.265 mm (centre filaments), lay length 6.3 mm
(Z-lay)+8×0.245 mm (filaments), lay length 12.5 mm
(Z-lay)+14×0.245 mm (filaments), lay length 18 mm
$\alpha_2$=11.02°; $\alpha_3$=12.45°
cord: lay length of 50 mm, S-lay

The invention claimed is:

1. A steel cord adapted for the reinforcement of rubber products, said steel cord being a multi-strand structure that includes a core strand and multiple peripheral strands concentrically surrounding said core strand;

each of said core and peripheral strands comprising a centre of two or more centre filaments and two layers of filaments surrounding the centre;

the core strand having a diameter D1 which is greater than the diameter D2 of the peripheral strands; a radially outer layer having a twist angle which is greater than a twist angle of a radially inner layer of the same strand;

wherein said cord comprises six of said peripheral strands concentrically surrounding said core strand, and wherein in said cord each of the strands is composed of no more than twenty-six filaments being twisted together, and in each strand the diameter of the filaments in the centre are greater than or equal to the diameter of the filaments of the radially inner layer.

2. A steel cord as claimed in claim 1, wherein the number of centre filaments of each of said core and peripheral strands is two.

3. A steel cord as claimed in claim 2, wherein each of said core and peripheral strands further has a radially inner layer of eight filaments and a radially outer layer of fourteen filaments being twisted with the centre filaments.

4. A steel cord as claimed in claim 2, wherein each of said core and peripheral strands further has a radially inner layer of seven filaments and a radially outer layer of thirteen filaments being twisted with the centre filaments.

5. A steel cord as claimed in claim 1, wherein the number of centre filaments of each of said core and peripheral strands is three.

6. A steel cord as claimed in claim 5, wherein each of said core and peripheral strands has a radially inner layer of eight filaments and a radially outer layer of fourteen filaments being twisted with the centre filaments.

7. A steel cord as claimed in claim 5, wherein each of said core and peripheral strands has a radially inner layer of seven filaments and a radially outer layer of thirteen filaments being twisted with the centre filaments.

8. A steel cord as claimed in claim 1, wherein all the layers of the core strand are twisted in a first direction, the layers of the peripheral strands being twisted in said first direction, the peripheral strands being twisted around the core strand in a direction opposite to the first direction.

9. A steel cord as claimed in claim 1, wherein the ratio of core strand diameter to peripheral strand diameter D1/D2 is greater than 1.06 and smaller than 1.20.

10. A steel cord according to claim 1, wherein the diameter of the filaments of each of said core and peripheral strands ranges from 0.15 mm to 0.38 mm.

11. A steel cord according to claim 1, wherein the filaments of each of said core and peripheral strands are provided with a coating of zinc or a zinc alloy.

12. An off the road tire comprising the steel cord of claim 1.

13. A rubber track comprising the steel cord of claim 1.

14. A steel cord according to claim 1, wherein in each strand the diameter of the filaments in the centre are greater than the diameter of the filaments of the radially inner layer.

* * * * *